United States Patent [19]

Havens

[11] Patent Number: 5,050,890

[45] Date of Patent: Sep. 24, 1991

[54] DART BOARD GAME

[76] Inventor: Randal L. Havens, 9880 E. Twin Bridges Rd., Warren, Ill. 61087

[21] Appl. No.: 637,770

[22] Filed: Jan. 7, 1991

[51] Int. Cl.[5] ..... F41J 3/00; F41J 3/02

[52] U.S. Cl. ..... 273/408

[58] Field of Search ..... 273/408, 409

[56] References Cited

U.S. PATENT DOCUMENTS 1,527,480 2/1925 Hooper ..... 273/408
3,059,928 10/1962 Flanagan ..... 273/408
3,979,117 9/1976 Worsham ..... 273/408
4,183,530 1/1980 Roop ..... 273/247

*Primary Examiner*—William H. Grieb

[57] ABSTRACT

A dart game in which the dart board is subdivided into two separate zones. A number of circular targets are arranged in each zone, such that each player throws at targets in the other player's zone. Ancillary spaces are marked in each zone of the dart board for introducing different strategies into the game. Such spaces are usable to increase or decrease the number of darts in the game, or to increase the number of hits required to destruct a circular target.

5 Claims, 1 Drawing Sheet

DART BOARD GAME

BACKGROUND AND SUMMARY OF THE INVENTION

This invention relates to a dart game that includes a rectangular dart board subdivided into two equal size zones. Three or four circular targets are located at different points in each zone. Each circular target represents a military unit, e.g. a surface ship, or a submarine, or an airplane, or a military tank. One player owns the military units (targets) in one zone. The other player owns the military units (targets) in the other zone.

Each player is given a supply of darts, e.g. four or five darts. One player throws his/her darts toward the other player's targets (military units). The other player then throws his/her darts toward the first player's targets. The process is repeated, with each player having a turn throwing the supply of darts at the other player's targets.

The object of the game is for each player to destroy the other player's targets by throwing darts onto such targets a specified number of times, e.g. four or five times. The winner is the player who first destroys all of the other players targets (military units).

The dart board has additional spaces marked thereon for the purpose of introducing offensive and defensive strategies into the game. One offensive strategy is provided by a dart-regain space in each zone; when the player's dart strikes such a space he/she is given an extra dart, thereby increasing his/her offensive capability. Another offensive strategy is provided by power token spaces marked in each zone; when a player's dart strikes a power token space he/she is enabled to multiply the effect of subsequently thrown darts on the opposing player's targets. For example, if a player has acquired a power token (by landing a dart in a power token space) he/she is permitted to place a doubled value on the next dart thrown at the opposing player's targets; if the dart strikes the target it has the same scoring effect as two hits would have.

A defensive strategy is introduced into the game, by means of two or more shield-increase spaces marked in each zone. If a player's dart lands in a shield-increase space he/she is enabled to increase the number of hits required to destroy any designated target under that player's control. The player can thus employ a defensive strategy to protect (shield) designated targets from destruction by the opposing player's darts.

Another defensive strategy is provided by one or more dart-loss spaces marked in each zone. If a player's dart lands on the other player's dart-loss space the other player is required to give up one of his/her darts. This reduces one player's offensive capability, and in a relative sense increases the other player's defensive capability.

As far as I know, there are no prior art dart board games having the above-described target arrangements and ancillary spaces for achievement of offensive and defensive strategies.

U.S. Pat. No. 4,183,530 to S. Roop, shows a dart board marked to simulate a football field. Players throw darts at selected areas of the field to advance the player's position on the field.

U.S. Pat. No. 3,979,117 to R. Worsham, shows a football dart board having three separated target areas simulating pass plays, running plays, and kicks. The players select the target areas to be thrown at, as required by the football rules and situations.

The present invention is believed to be a departure from the inventions disclosed in the noted patents.

THE DRAWINGS

DESCRIPTION OF A PREFERRED EMBODIMENT OF THE INVENTION

Figure 1:
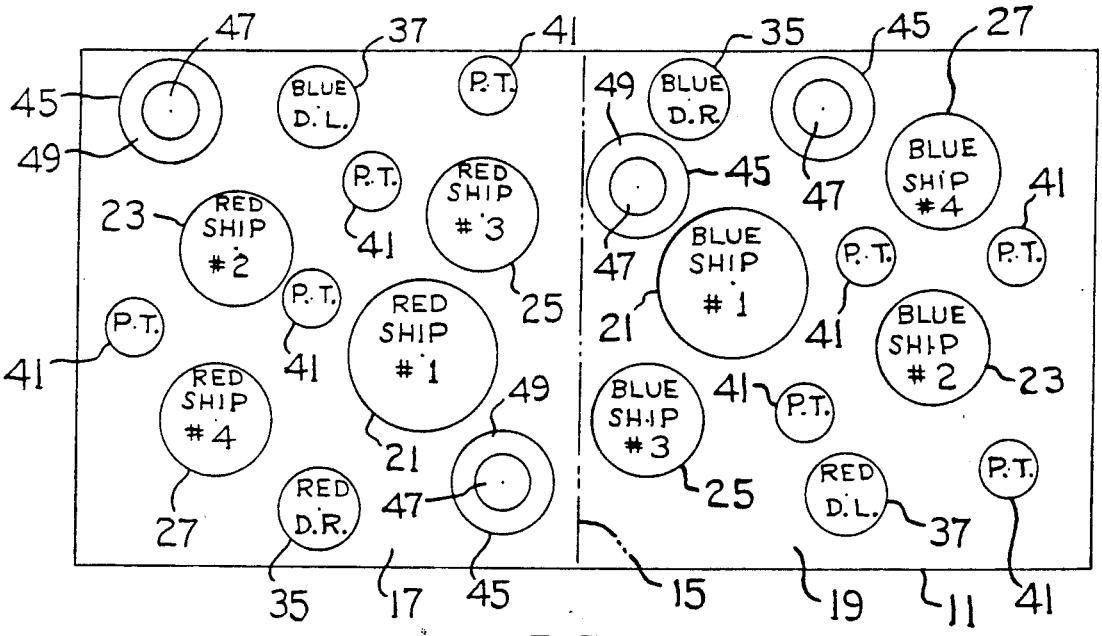
FIG. 1 is a plan view of a game dart board embodying features of the invention.
Figure 3:
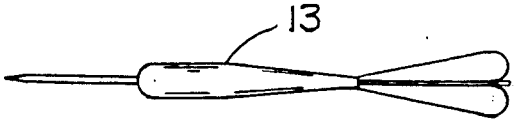
FIG. 3 illustrates a type of dart that can be used with the FIG. 1 dart board.

FIG. 1 shows a rectangular dart board 11 having markings thereon in accordance with the present invention. FIG. 3 shows a representative dart 13 adapted to be thrown at the FIG. 1 board. In a representative game, board 11 might have a length on the order of four feet and a width on the order of two feet. Each dart 13 could have a length on the order of five inches. The dart game is played by two players. Each player is initially supplied with four or more darts, depending on player agreement. During the course of the game additional darts may be supplied to either player; alternately some darts may be taken away from a player, depending on whether a player's dart happens to strike a dart-loss space or a dart-regain space on board 11.

The players take turns throwing darts at the game board. For example, one player throws individual darts at the board until his/her supply of darts is exhausted. The opposing player then throws individual darts at the board until that dart supply is exhausted. This process is repeated during the course of the game.

A median line 15 on board 11 subdivides the board into two equal size zone, designated in FIG. 1 by numerals 17 and 19. In each zone there are four circular targets 21, 23, 25 and 27. Each circular target represents one military unit, which may be a military ship, military aircraft, or military tank. A picture of the military device, e.g. a ship, is printed within each of the four target circles. In the illustrated board the military device is a ship.

The circular targets in zone 19 are considered to be owned or controlled by one of the players, which we can designate as the blue player. The circular targets in zone 17 are considered to be owned or controlled by the other player, herein designated as the red player. The red player seeks to win the game by throwing his/her darts onto the target circles in the blue player's zone 19. Conversely, the blue player seeks to win the game by throwing his/her darts onto the target circles in the red player's zone 17. The winner of the game is the player who destroys all of the other players military units (target circles 21, 23, 25 and 27) by landing a specified number of darts thereon.

Figure 2:
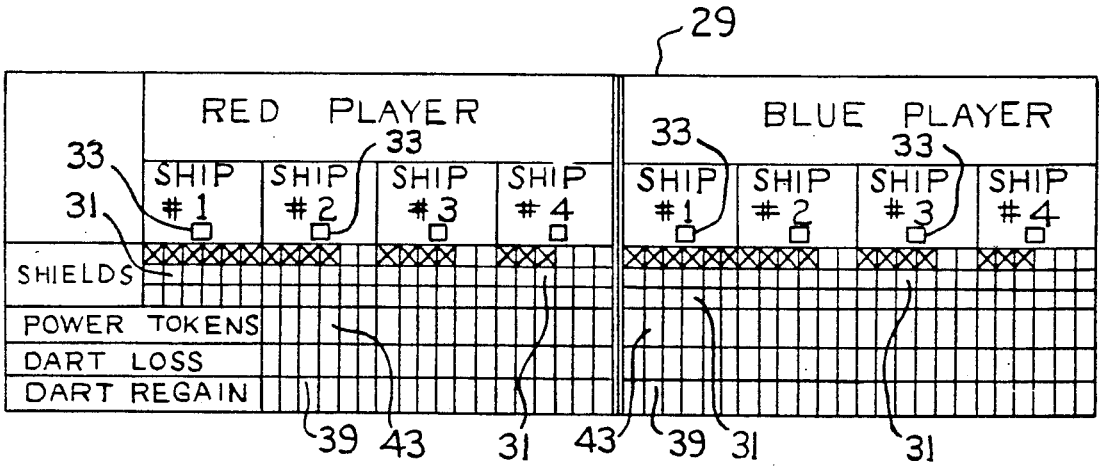
FIG. 2 illustrates a scoring sheet used in conjunction with the FIG. 1 dart board.

The number of dart landings (hits) required to destroy each target circle may be varied according to player agreement. With a lesser number of hits required, the game will be shorter in duration. With a greater number of hits required, the game will be of longer duration. A score sheet 29 is used to indicate the number of hits required to destroy each military unit (ship). The required number of hits is expressed as "shields" on the sore sheet; when the hits on a ship exceed the number of shields the ship is considered destroyed. With the FIG. 2 score sheet, each shield is designated by an x in the shield indication area 31 on the sheet. Seven hits are required to destroy ship #1 (target circle 21); five hits are required to destroy ship #2 (target circle 23); five hits are required to destroy ship #3 (target circle 25); four hits are required to destroy ship #4 (target circle 27). Each hit is recorded on the score sheet by running a pencil over an x in area 31 (to obliterate the x). The destruction of a target (ship) is recorded by marking box 33 for the particular ship. When all four boxes 33 are so marked the game is completed.

As previously noted, there are additional spaces marked in each zone of board 11 for the purpose of introducing offensive and defensive strategies into the game. In the area of offensive strategy, each zone includes one space 35 designated as a dart regain (D.R.) space. When space 35 in zone 17 is impacted by a dart the red player is given one extra dart; he/she can then use one more dart during each subsequent turn. When space 35 in zone 19 is impacted by a dart the blue player is given one extra dart. An upper limit can be placed on the number of darts.

Placement of spaces 35 is such that each player has to use care when aiming his/her darts at the opposing players targets 21, 23, 25 and 27. If the dart is off course and strikes space 35 in the opposing player's zone, the opposing player will be awarded an extra dart for his/her subsequent use.

Each zone 17 or 19 also has one space 37 designated as a dart loss (D.L.) space. When space 37 in zone 17 is impacted by a dart the blue player loses one dart in his/her dart supply. When space 37 in zone 19 is impacted by a dart the red player loses one dart in his/her supply. Each player thus risks losing one dart if his/her dart misss the opposing player's target circles 21, 23, 25 and 27.

Score sheet 29 has spaces at 39 for recording each dart loss or each dart regain; an x in each box in space 39 designates the dart loss or dart regain. By noting the number of x's it is possible to ascertain the correct number of darts to be supplied to each player for the next turn.

Each zone 17 or 19 has four additional spaces 41 designated as power token (P.T.) spaces. When a player's dart impacts any one of the P.T. spaces 41 he/she is awarded one power token; the award is designated with an x in area 43 on score sheet 29. A power token can be used by the player to increase the effect of a subsequently-thrown dart against any designated enemy target circle 21, 23, 25 or 27. For example, if a player is awarded a power token he/she can use it to double the effect of a hit on an enemy target circle. If the target circle is struck by the dart, the player is allowed to obliterate two x's in shield area 31 of the score sheet (instead of one). If the target circle is missed, the player merely loses the power token; the usage of a power token is documented by obliterating an x in area 43 of the score sheet.

To introduce a defensive strategy into the game, two shield-increase spaces 45 are provided in each zone 17 and 19. If a player's dart impacts a shield-increase space 45 he/she is given one or two extra shields for inclusion in area 31 of the score sheet. Each space 45 comprises two concentric circles that subdivide the space into an inner circular area 47 and an outer annular area 49; the diameter of each circle 47 is preferably about the same as the diameter of each P.T. circular space 41. If a dart impacts circular area 47 the player is awarded two additional shields; if the dart impacts annular area 49 the player is given one additional shield. The appropriate number of x's is entered in pencil in area 31 on score sheet 29.

These additional shields add a defensive strategy to the game, in that any shield can be applied to any one of the player's four ships. Thus, if a player sees that one of his ships is in danger of being destructed he/she can aim a dart at one of the shield-increase spaces 45. If the dart throw is successful the player can apply the awarded shield (or shields) to the ship in danger.

It will be noted that there are four target circles in each player zone, and that each target can be protected by selectively adding one or more shields thereto. A hit on one of the ships (targets) does not affect other targets (ships). Once a target has been destroyed any subsequent hits on that target have no effect. A hit on one ship cannot be applied against another ship.

The dart board game involves both offensive and defensive strategies, which makes it more interesting than a dart game where the sole strategy is offensive in nature.

I claim:

1. Apparatus for a dart game played by two people, comprising a supply of darts for each player; a rectangular dart board subdivided into two equal size rectangular zones, one for each player; a plural number of targets located in each zone; the targets in one zone representing military units controlled by one player; the targets in the other zone representing military units controlled by the other player, whereby each player attempts to destroy the opposing player's targets by throwing darts onto the respective targets a specified number of times; a number of shield-increase spaces in each zone; each shield-increase space being effective when struck by a dart to increase the number of times that a player's target must be struck before being considered destroyed; at least one dart-loss space in each zone; each dart-loss space being effective when struck by a dart to require a reduction in the number of darts supplied to a specified player; at least one dart-regain space in each zone; each dart-regain space being effective when struck by a dart to require an increase in the number of darts supplied to a specified player; and a plural number of power token spaces in each zone; each power token space being effective when struck by a dart to enable a player to multiply the effect of a thrown dart on a struck target; each dart-loss space being located in the zone containing the opposing player's targets, whereby a player throwing a dart at the opposing player's target runs the risk of losing a dart if that dart should be off course; each dart-regain space being located in the specified player's zone, whereby a player throwing a dart at the dart-regain space runs the risk of striking his own target if that dart should be off course.

2. The apparatus of claim 1, wherein there are four targets in each zone, each target having a circular configuration.

3. The apparatus of claim 2, wherein the targets in each zone have varying diameters.

4. The apparatus of claim 1, wherein each shield-increase space is formed by two concentric circles that subdivide the shield-increase space into an inner circular area and an outer annular area; each said inner circular area having twice the value of the associated annular area when struck by a dart.

5. The apparatus of claim 4, wherein each power token space has a circular configuration; the diameter of each power token circle being approximately the same as the diameter of the inner circle in each shield-increase space.

* * * * *